US006698388B2

(12) United States Patent
Brace et al.

(10) Patent No.: US 6,698,388 B2
(45) Date of Patent: Mar. 2, 2004

(54) INTERNAL COMBUSTION ENGINE COOLING SYSTEM

(75) Inventors: Christian John Brace, Radstock (GB); Niall Andrew Fraser Campbell, Bradford on Avon (GB); John Gary Hawley, Trowbridge (GB); Matthew James Leathard, Plymouth (GB); Kevin Robinson, Warminster (GB); Alexios Vagenas, Patras (GR); Mathew Haigh, Chelmsford (GB); Chris Whelan, Southwick (GB); Steven Joyce, Redhill (GB); Iaim Gouldson, Leigh on Sea (GB)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/219,787

(22) Filed: Aug. 15, 2002

(65) Prior Publication Data

US 2003/0075120 A1 Apr. 24, 2003

(30) Foreign Application Priority Data

Aug. 16, 2001 (GB) ..... 0120052

(51) Int. Cl.[7] ..... F01P 7/10

(52) U.S. Cl. ..... 123/41.28; 123/41.29

(58) Field of Search ..... 123/41.1, 41.28, 123/41.29, 41.31, 41.08, 41.79

(56) References Cited

U.S. PATENT DOCUMENTS 4,370,950 A 2/1983 Furukubo

*Primary Examiner*—Noah P. Kamen
(74) *Attorney, Agent, or Firm*—Brinks Hofer Gilson & Lione

(57) ABSTRACT

This invention relates to a method of cooling an internal combustion engine, to an internal combustion engine assembly. The invention provides an internal combustion engine which has a primary and a secondary flow of coolant together with a method of cooling such and engine. The secondary flow of coolant is injected into the primary flow of coolant in dependence upon a variable provided by a sensor, which provides an indication of the temperature of the engine body in the region where the secondary flow of coolant mixes with the primary flow of coolant.

38 Claims, 4 Drawing Sheets

INTERNAL COMBUSTION ENGINE COOLING SYSTEM

CROSS REFERENCE TO RELATED APPLICATION

This application claims the benefit of United Kingdom patent application number 0120052.6, filed Aug. 16, 2001, and entitled "Internal Combustion Engine Cooling".

BACKGROUND AND SUMMARY OF THE INVENTION

This invention relates to the cooling of internal combustion engines. More particularly the invention relates to a method of cooling an internal combustion engine, to an internal combustion engine assembly including a cooling system, and to an internal combustion engine body incorporating passageways for coolant.

In a conventional internal combustion engine, it is common to provide passageways in the engine body, and to pass coolant through those passageways during operation of the engine to prevent the engine body from overheating. In a typical arrangement, coolant is heated as it passes through the engine body and is then cooled by being passed through a heat exchanger, such as a radiator, before being passed through the engine body again.

Such a cooling system is simple and economical but is also relatively inflexible. In a typical internal combustion engine body, some regions of the engine body are likely to receive relatively large amounts of heat during operation of the engine. The flow rate of the coolant needs to be sufficient to avoid overheating of the engine body in these regions, but may result in other parts of the engine body being cooled to a lower temperature than is necessary or desirable, because of the high flow rate of the coolant, and may also lead to an excessive amount of power being required to circulate the coolant. The situation is further complicated because the various regions of the engine body may receive different amounts of heat according to the condition of the engine and/or the conditions under which it is operating.

It is an object of the invention to provide a method of cooling an internal combustion engine.

It is a further object of the invention to provide an improved internal combustion engine assembly.

It is a still further object of the invention to provide an improved internal combustion engine body.

According to the invention there is provided a method of cooling an internal combustion engine, including the steps of:

(a) providing a circulating primary flow of coolant through passageways in the engine body and a pump, the coolant being heated by the engine body as it flows through the passageways and being cooled after its passage through the engine body, (b) providing a secondary flow of coolant by removing coolant from the primary flow and injecting it into and mixed with the primary flow at a predetermined location in the engine body, (c) monitoring a variable that provides an indication of the temperature of the engine body in the region where the secondary flow of coolant mixes with the primary flow of coolant, and (d) controlling the injection of the secondary flow of coolant into the primary flow in dependence upon the indicated temperature.

The invention further provides an internal combustion engine assembly including:

an engine body and passageways in the engine body defining a flow path for a primary flow of coolant through the engine body, a pump for generating the primary flow of coolant, a passage in the engine body leading into the flow path of the primary flow of coolant for enabling a secondary flow of coolant to be injected into and mixed with the primary flow at a predetermined location in the engine body, a sensing device for sensing a variable that provides an indication of the temperature of the engine body in the region where the secondary flow of coolant mixes with the primary flow of coolant, and a control system for controlling the injection of the secondary flow of coolant into the primary flow in dependence upon a signal from the sensing device.

The invention still further provides an internal combustion engine body including:

passageways in the engine body defining a flow path for a circulating primary flow of coolant through the engine body, a passage in the engine body leading into the flow path of the primary flow of coolant for enabling a secondary flow of coolant to be injected into and mixed with the primary flow at a predetermined location in the engine body, and a temperature sensing device in the region where the secondary flow of coolant mixes with the primary flow of coolant.

By injecting a secondary flow of coolant into the primary flow, it is possible to increase the heat transfer from the engine body to the coolant, and a substantially greater cooling effect in the region of the injection can be obtained by a flow rate of the sum of the primary and secondary flows as compared with the same flow rate provided as a primary flow only. Thus, the power required to circulate the coolant can be reduced, leading to reduced fuel consumption. Furthermore, by assessing the temperature in the region of the enhanced cooling effect and controlling the secondary flow in response to that assessment, it becomes possible not only to achieve greater cooling but also to achieve better control of cooling and, in particular, to provide controlled cooling at different and variable levels in one or more localized regions of the engine body. For example, the secondary flow can be injected into a region of the engine body that otherwise would be particularly hot and can thereby maintain that part of the engine body at a lower temperature, while other parts of the engine body where the cooling from the primary flow is already more than adequate are not cooled any further. By maintaining the various parts of the engine body closer to their ideal temperature, emissions can be reduced and engine component integrity and durability improved. Furthermore, the secondary flow of coolant, and if desired also the primary flow, can be arranged not to be initiated during cold start conditions, thereby saving power and leading to a faster warm-up of the engine and reduction in emissions. Also, the injection of the secondary flow into the primary flow can be employed to reduce any tendency of the coolant to boil in a particular location. Not only may the secondary flow reduce the temperature of the primary flow but it may also, more significantly in terms of avoiding boiling, increase the pressure of the coolant in the region of injection.

Thus, in summary the invention enables much improved control of engine body temperatures while at the same time enabling overall coolant flow rates to be reduced.

The flow velocity of the secondary flow of coolant is preferably substantially greater than the flow velocity of the primary flow of coolant prior to the mixing of the flows, although the volume flow rate (or mass flow rate) of the secondary flow of coolant injected into the primary flow is preferably substantially less than the volume flow rate (or mass flow rate) of the primary flow of coolant into which the secondary flow is injected. Preferably the flow velocity of the secondary flow is at least twice the flow velocity of the primary flow prior to mixing of the flows. Also, preferably the volume flow rate of the secondary flow of coolant injected into the primary flow is less than half the volume flow rate of the primary flow of coolant into which the secondary flow is injected.

The secondary flow of coolant is injected into the primary flow as a jet. It is believed that a factor in enhancing the cooling effect in the region of the injection of the secondary flow is that turbulence is created in the coolant and, as a result, heat transfer between the coolant and the engine body is enhanced. Preferably, the jet is directed through the primary flow onto a surface of the engine body. In that case, the boundary layer of coolant flowing along the passageway is disrupted and either destroyed or significantly reduced in thickness, thereby enhancing the heat transfer between the coolant and the engine body.

The cross-sectional area of the passageway for primary flow and of the passagway for secondary flow will be dependent upon the size of the engine cylinders. In the case of an engine for a road vehicle, the passage for the secondary flow may have a diameter in the range of 2 to 15 mm where the secondary flow of coolant is injected into the primary flow. Preferably, the cross-sectional area of the passageway for the secondary flow of coolant is less than one third of the cross-sectional area of the passageway for the primary flow of coolant where the secondary flow is injected into the primary flow.

The jet of the secondary flow may be directed in an opposing direction of the primary flow of coolant, but it may be preferred that the jet has a direction that has a substantial component aligned with the direction of primary flow of coolant at the predetermined location. For example, the secondary flow may be inclined at an angle on the order of 45° to the direction of primary flow. Alternatively, the secondary flow jet may be directed substantially perpendicularly to the direction of primary flow of coolant at the predetermined location.

Although the primary and secondary flows are described as "circulating", it should be understood that they do not necessarily operate continuously during operation of the engine. The reference to "circulating" rather indicates that the flow is around a circuit.

The secondary flow of coolant may be a pulsed flow. The pulsing of the flow is able to generate increased turbulence and increased disruption and penetration of the boundary layer of the primary flow of coolant, as compared to a steady secondary flow of coolant of the same overall flow rate.

The optimum frequency of the pulses will be dependent on the particular physical arrangement, but is preferably in the range of 0.2 to 50 Hz and, for most cases, is in the range of 1 to 10 Hz.

Pulsing of the flow can conveniently be achieved by opening and closing of a control valve in the path of the secondary flow.

While it is possible that in a particular case, the secondary flow of coolant would be injected into the primary flow at only one predetermined location, it is more likely that coolant from the secondary flow is injected into the primary flow at a plurality of predetermined locations in the engine body. For example, it may be desirable to have one injection of secondary flow per cylinder in the engine. Where there is more than one injection of secondary flow, each may be independently controlled or the injections may be controlled together. Thus, the injection of coolant at a first predetermined location may be controlled separately from the injection of coolant at a second predetermined location. It is also possible for a respective variable that provides an indication of temperature to be monitored for each region where the secondary flow of coolant is injected, thereby enabling each injection to be separately controlled relying upon each sensed variable. Thus, a plurality of temperature sensing devices may be provided with each device being located in the region of a respective one of the predetermined locations in the engine body. Providing separate sensing devices and controlling each injection of secondary flow separately improves control but also increases cost.

In a case where the secondary flow of coolant is a pulsed flow and the secondary flow is injected into the primary flow at a plurality of locations, it may be advantageous to arrange for the secondary flow at one location to be taking place when the flow at another location is not, in order that the variation with time in the overall secondary flow rate as a result of the pulsing is reduced or even eliminated. Such an arrangement may be achieved by providing a pump which delivers a pulse of secondary flow to each location.

There are various approaches that may be adopted for obtaining an indication of the temperature in the region of the engine body where the secondary flow of coolant mixes with the primary flow. A simple and direct approach involves measuring a temperature within the engine. That is a simple and direct approach but it may not be possible or economical to locate a temperature sensing device where required, and alternative approaches may therefore be preferred. For example, the composition of the products of combustion, for example, the amount of nitrous oxides, may be used as an indication of engine body temperature. In one approach where temperature is sensed directly, the temperature of part of the engine body immediately adjacent to the mixing of the primary and secondary flows is sensed. Thus, the temperature sensing device is located in the engine body immediately adjacent to the predetermined location. Such an approach has the advantage of providing a direct measurement of the temperature of the part of the engine body most affected by the injection of the secondary flow. In another approach, the temperature of part of the engine body in the vicinity of, but spaced from, the mixing of the primary and secondary flows is sensed. With such an approach, it is still possible to provide an indication of the temperature of the part of the engine body most affected by the injection of the secondary flow because changes in temperature of one part of the engine body will be reflected in changes in temperature in a neighbouring part. This approach may be especially advantageous in a case where the physical arrangement of the engine makes it difficult or impossible to sense the temperature of part of the engine body immediately adjacent to the mixing of the primary and secondary flows.

Preferably, the secondary flow of coolant is generated independently of the primary flow. The secondary flow may be determined by a variable speed pump, the operation of which is controlled in dependence upon the monitored temperature and the pump may be an electric pump. In a case where the secondary flow of coolant is injected into the primary flow at a plurality of locations, it is preferred that a single pump be provided and that, if the injections at the plurality of locations are separately controlled, respective control valves are provided for each of the injections.

It is also preferred that the primary flow of coolant is generated by an electric pump. Although in certain applications it may be desirable, for example for reasons of cost, for the primary flow to be generated by a pump driven mechanically by the engine.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE INVENTION

Figure 1:
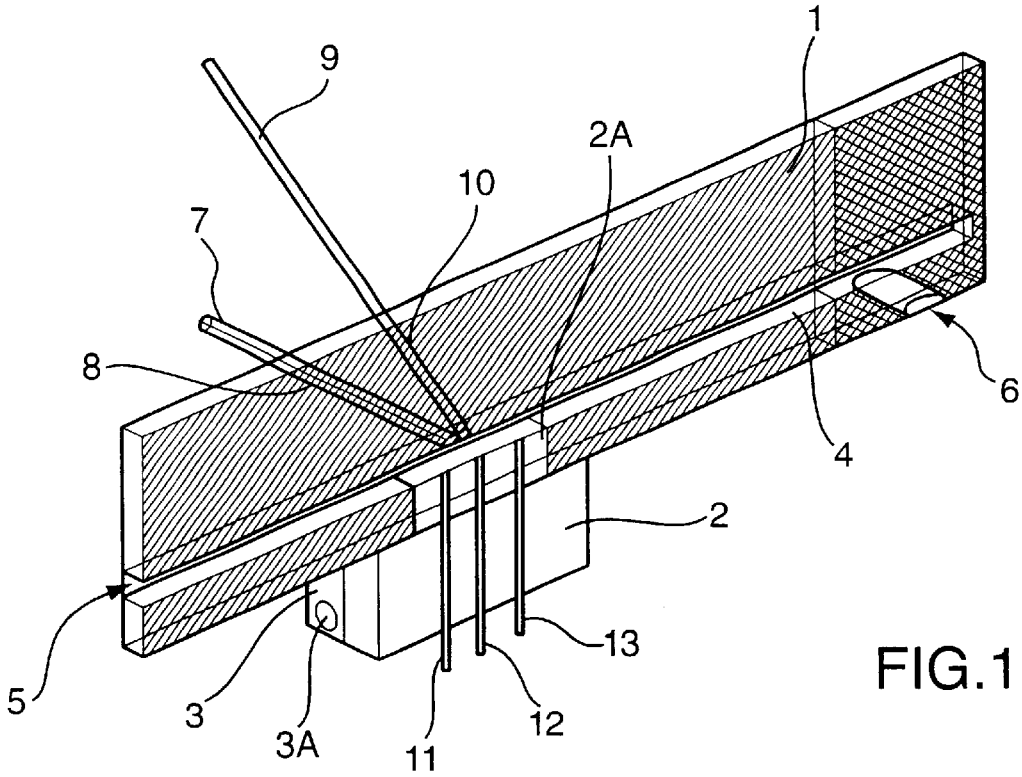
FIG. 1 is a perspective cut-away view of an experimental rig employed in developing the invention.

Referring to FIG. 1, the rig shown comprises a main rectangular, elongate block 1 of stainless steel, which in FIG. 1 is shown in longitudinal section, and a block 2 of aluminium having an upper projecting part 2A which fits within a correspondingly shaped recess formed in the underside of the block 1. A heater block 3 of copper, containing a heater 3A, is fixed to the back of the block 2 to heat the block 2. A passageway 4 of rectangular cross-section extends along the length of the block 1, and is open at one end to define an inlet 5. At the other end the passageway is closed but an outlet 6 in the bottom of the block is in fluid communication with the passageway at that end. The passageway 4 passes over the top of the block 2 and in that region, the lower boundary of the passageway is defined by the top of upper projection 2A of the heater block.

A tube 7 is located in block 1 with the axis of the tube disposed in the vertical plane containing the longitudinal axis of the passageway 4 and inclined at an angle of 45° to passageway 4. The tube 7 terminates flush with the top boundary wall of passageway 4 and defines a passage 8 leading into passageway 4.

A further tube 9 is located in the block 1 with the axis of the tube disposed at 45° to the horizontal in a vertical plane perpendicular to the longitudinal axis of passageway 4. The tube 9 terminates flush with a side boundary wall of passageway 4 and defines a passage 10 leading into the passageway 4.

Three thermocouples 11, 12, 13 are mounted in blind bores in block 2 and are able to sense the temperature in block 2 immediately adjacent to passageway 4. Each thermocouple is movable within its respective blind bore from a position about 2 mm from passageway 4 to a position about 12 mm from passageway 4. As can be seen in FIG. 1, thermocouple 12 is located approximately on the axes of tubes 7 and 9, while thermocouple 11 is located upstream of that location and thermocouple 13 is located downstream of that location.

Figure 2:
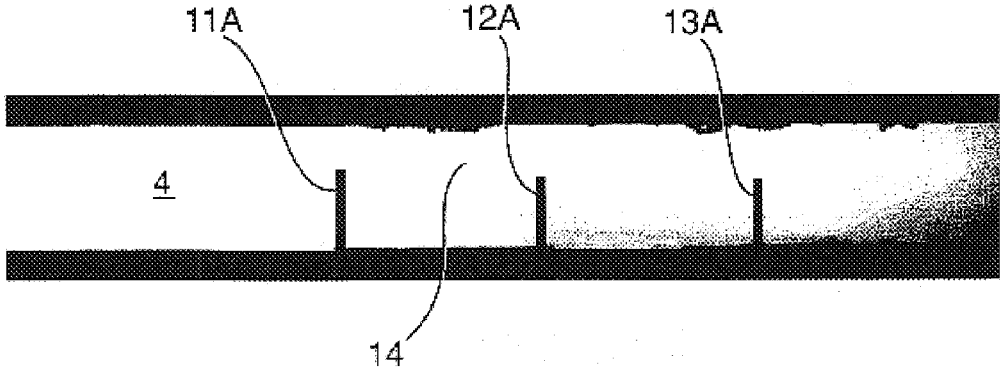
FIG. 2 is a photographic representation of coolant flows generated during use of the rig shown in FIG. 1.

In use of the experimental rig shown in FIG. 1, coolant is pumped into inlet 5 of passageway 4 to form a primary flow and is also pumped into one of the tubes 7 and 9 (the other one being blocked) to form a secondary flow that mixes with the primary flow when it reaches passageway 4. The combined flows then pass along the rest of passageway 4 and exit through outlet 6. FIG. 2 provides a photographic representation showing the secondary flow through passage 8 of tube 7 (tube 9 being blocked) joining the primary flow along passageway 4. Dye is added to the coolant entering through passage 8. As can be seen from FIG. 2 (where lines 11A to 13A mark the axial positions of thermocouples 11 to 13 respectively), coolant flowing through passage 8 and leaves the end of passage 8 as a jet 14 and passes across passageway 4 to the upper face of heater block 2 in the vicinity of thermocouple 12. Thereafter, jet 14 mixes with the primary flow along passageway 4. As can be seen from FIG. 2, the coolant from jet 14 spreads out quickly throughout passageway 4 once it has crossed the passageway.

In a particular example of the rig, passageway 4 has a height of 10 mm and a width of 16 mm, the heater block is formed of an aluminium alloy with a surface finish as cast, and the coolant employed in both the primary and secondary flow is a conventional coolant and in the automotive industry; namely, a 50:50 mix by volume of distilled water and Texaco OAT coolant. The coolant is maintained at a temperature of 90° C.

Tests were carried out employing each of the tubes 7 and 9, with internal diameters in each case of both 3 mm and 5 mm. The speed of the primary flow through passageway 4, prior to injection of the secondary flow, was chosen to be either 0.25 m/s or 1 m/s, and the speed of the secondary flow through the passage 8 or 10 chosen to be 0 m/s (for comparison purposes), 1 m/s, 3 m/s and 5 m/s.

Figure 3:
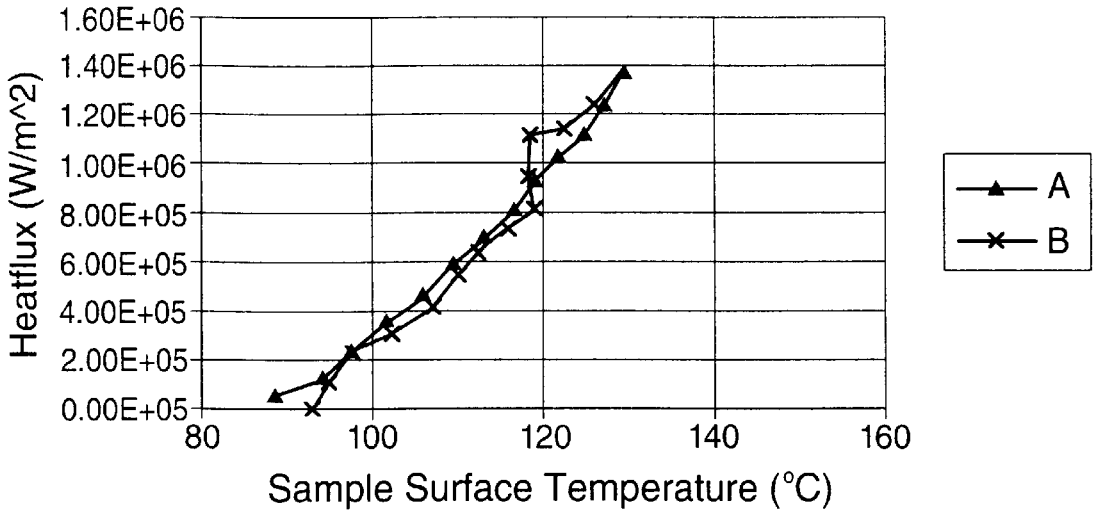
FIG. 3 is a graph of experimental results obtained from using the rig of FIG. 1 in which heat flux into coolant is plotted against temperature of a surface adjacent to the coolant.

The tests showed that injection of coolant through either of tubes 7 and 9 enhanced the cooling of block 2 much more than if the injected coolant were instead simply included in the coolant flow. A striking example of this is shown in FIG. 3 where certain experimental results are shown in graphical form. The y-axis of the graph shows the heatflow from upper projection 2A of block 2 into the coolant, measured in $W/m^2$, and the x-axis shows the surface temperature of the upper projection 2A of block 2, as measured by thermocouple 13. The graph plots the results from two flow cases: in case A, where points are marked by triangles, coolant was injected through the tube 7 (secondary flow), while in case B, where points are marked by crosses, no coolant was injected through tube 7 but the total flow rate was higher. The flow conditions are tabulated below:

| | Case A | Case B |
|---|---|---|
| Primary flow speed before injection | 1 m/s | 5 m/s |
| Primary flow rate before injection | 9.6 l/min | 48 l/min |
| Secondary flow speed at injection | 3 m/s | 0 |
| Secondary flow rate at injection | 3.5 l/min | 0 |
| Diameter of injected flow | 5 mm | — |
| Combined flow rate after injection | 13.1 l/min | 48 l/min |

It may be noted in FIG. 3 that the heat flux transferred from block 2 is plotted against sample surface temperature. For each measurement heater 3A was set to a selected level and the temperature monitored until a steady state condition was obtained; in the steady state, the heat flux is calculated by measuring the temperature of the block with thermocouple 13, that thermocouple first being placed 2 mm from passageway 4 and then being retracted to a position 12 mm from passageway 4; from the difference in temperature the heat flux through block 2 can be calculated. Also the temperature measurement by thermocouple 13 at a position 2 mm from passageway 4 can be adjusted with regard to the measured heat flux to calculate the temperature at the surface of block 2.

While in the example described a much lower flow rate with an injected secondary flow is employed to provide substantially the same cooling effect from much less flow, it should be understood that the same total flow rate could be employed to obtain a much greater cooling effect, or a somewhat lower flow rate employed to obtain a somewhat greater cooling effect.

Figure 4:
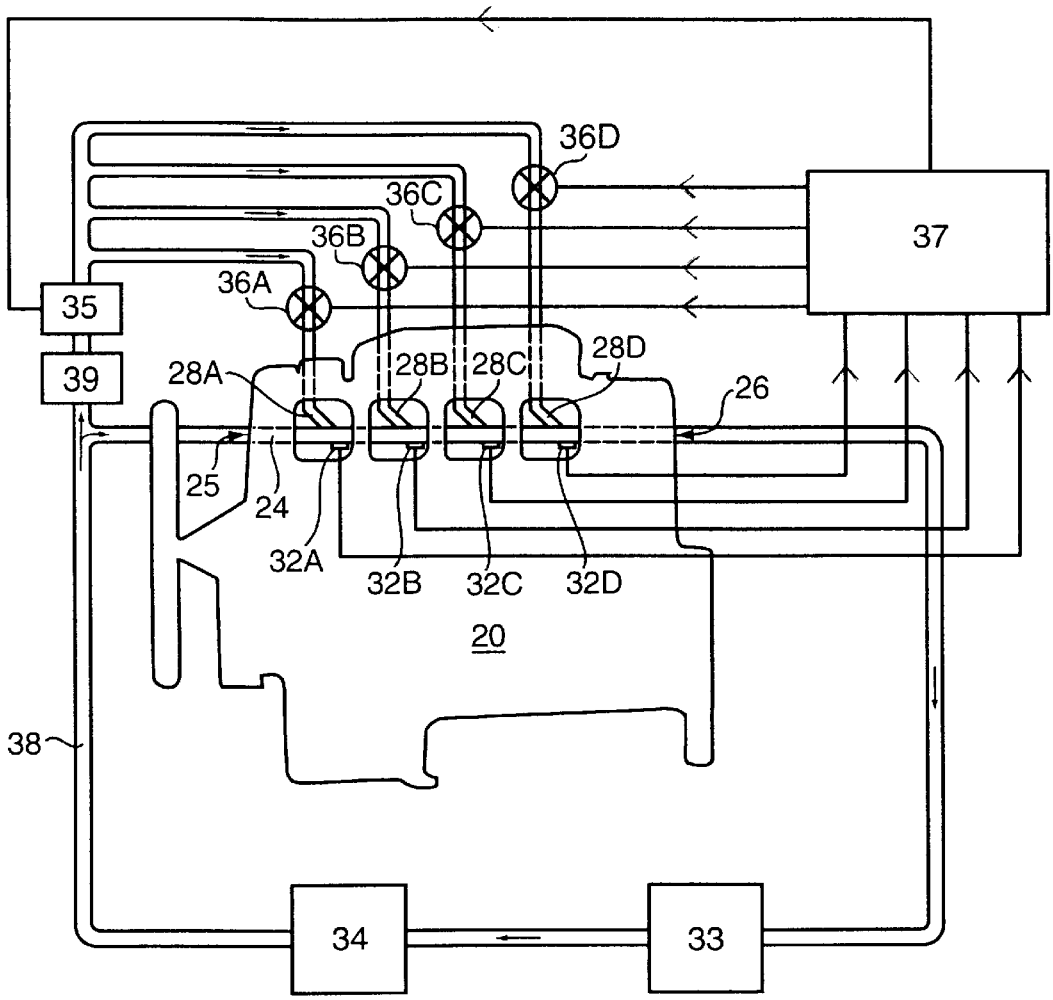
FIG. 4 is a schematic diagram of an internal combustion engine assembly embodying the invention.

As will be understood, many different practical implementations of the invention are possible. FIG. 4 provides a schematic diagram of just one example of the invention applied to a four cylinder internal combustion engine assembly.

Referring now to FIG. 4, a cylinder engine body 20 has four cylinders and a coolant passageway 24 which passes in a tortuous path (shown as straight in FIG. 4) through engine body 20, as is conventional, to cool the engine during operation. For each of the cylinders defined within the body 20, there is a region of the head where overheating is a particular concern and in each of those regions, for example the valve bridge regions, a respective passage 28A, 28B, 28C, 28D is connected from outside the engine body to passageway 24. The four junctions of passages 28A to 28D with passageway 24 are shown schematically in FIG. 4. Also shown schematically in that drawing are four temperature sensing devices 32A to 32D, each positioned at a respective junction.

Passageway 24 has an outlet end 26 which is connected to a heat exchanger 33, for example a radiator, and then to a pump 34 before being returned via a conduit 38 to the inlet end 25 of passageway 24. In this example, pump 34 is an electric pump but it may alternatively be mechanically driven from the engine, as is conventional practice.

A further electric pump 35 and heat exchanger 39 is provided. The pump is connected on its inlet side via heat exchanger 39 to conduit 38 and on its outlet side via respective valves, 36A to 36D to each of the passages 28A to 28D. An electric control system 37 is also provided which receives input signals from each of the temperature sensing devices 32A to 32D and provides output signals to electric pump 35 and each of the four valves 36A to 36D. Thus the temperature, pressure and speed of the flows of coolant through the respective passages 28A, 28B, 28C and 28D can be controlled.

In operation of the engine assembly shown in FIG. 4, the cooling system is first inoperative. Initially the engine is cold but as it warms up the temperature sensing devices 32A to 32D detect the temperature increase. Once a predetermined temperature is reached, pump 34 for generating the primary flow of coolant is actuated. Thereafter, if the temperature detected by one of the temperature sensing devices 32A to 32D passes a predetermined threshold level, then the control system reacts such that pump 35 is actuated and the associated one of valves 36A to 36D opened (with the other valves remaining closed). Coolant is then also caused to flow from conduit 38, through pump 35, through the open one of valves 36A to 36D, and is injected as a jet of coolant into passageway 24 at the location of the given temperature sensing device. In the event that the jet of coolant lowers the temperature below a predetermined limit, then the opened valve 36A to 36D is closed and, assuming no other of valves 36A to 36D are open, pump 35 is turned off.

Thus it will be seen that control system 37 is able to regulate the cooling of the engine body and provide greater amounts of cooling in one region than another. While at times all four of the valves 36A to 36D may be open, the control arrangement described can operate with any number of valves open and need not have all the threshold values of temperature at which the valves open the same for each valve.

As will be clear from the comments made above, there are many variations that can be made to the control arrangement that is described above by way of example. One modification which may be advantageous, is to provide a pulsed flow of coolant through passages 28A to 28D, when coolant is required. Such pulsing can be achieved by providing valves 36A to 36D that can be opened and closed rapidly and controlling the opening and closing from control system 37. Another way of achieving the pulsing is to arrange for pump 35 to deliver a pulse of coolant to each of passages 28A to 28D in turn.

The temperature sensing devices may be of any suitable kind and need not be thermocouples as in the case of the experimental rig. For example, thermistors may be used.

In the example shown in FIG. 4, coolant is injected at one point in the region of each cylinder but it should be understood that the injection could take place in other regions of the engine body as well or instead.

FIG. 4 shows an arrangement with a relatively extensive control system in that temperature is maintained in the region of each cylinder and injection of coolant at each injection point separately controlled. A less expensive arrangement would provide temperature monitoring in the region of one cylinder only and a common control for all the injections of the secondary coolant flows.

While the above description constitutes the preferred embodiment of the present invention, it will be appreciated that the invention is susceptible to modification, variation and change without departing from the proper scope and fair meaning of the accompanying claims.

What is claimed is:

1. A method of cooling an internal combustion engine, including the steps of:

providing a circulating primary flow of coolant through passageways in an engine body and a first pump, the coolant being heated by the engine body as it flows through the passageways and being cooled after the coolant passes through the engine body;

providing a secondary flow of coolant by removing the coolant from the primary flow and injecting the coolant into the primary flow and mixing the primary flow and the secondary flow at a predetermined location in the engine body;

monitoring a variable that provides an indication of a temperature of the engine body in the region where the secondary flow of coolant mixes with the primary flow of coolant; and controlling the injection of the secondary flow of coolant into the primary flow in dependence upon the indicated temperature.

2. A method according to claim 1, in which the flow velocity of the secondary flow of coolant is greater than the flow velocity of the primary flow of coolant immediately prior to the mixing of the flows.

3. A method according to claim 1, in which the volume flow rate of the secondary flow of coolant injected into the primary flow is less than the volume flow rate of the primary flow of coolant into which the secondary flow is injected.

4. A method according to claim 1, in which the secondary flow of coolant is injected into the primary flow as a jet.

5. A method according to claim 4, in which the jet has a direction that has a substantial component aligned with the direction of primary flow of the coolant at the predetermined location.

6. A method according to claim 4, in which the jet is directed substantially perpendicularly to the direction of primary flow of coolant at the predetermined location.

7. A method according to claim 1, in which the secondary flow of coolant is a pulsed flow.

8. A method according to claim 7, in which the pulses have a frequency in the range of 0.2 to 50 Hz.

9. A method according to claim 7, in which the pulses have a frequency in the range of 1 to 10 Hz.

10. A method according to claim 1, in which the coolant from the secondary flow is injected into the primary flow at a plurality of predetermined locations in the engine body.

11. A method according to claim 10, in which the injection of the coolant at a first predetermined location is controlled separately from the injection of the coolant at a second predetermined location.

12. A method according to claim 1, in which the step of monitoring a variable that provides an indication of the temperature of the engine body in the region where the secondary flow of coolant mixes with the primary flow comprises directly measuring a temperature within the engine body.

13. A method according to claim 12, in which the temperature of part of the engine body immediately adjacent to the mixing of the primary and secondary flows is sensed.

14. A method according to claim 12, in which the temperature of part of the engine body in the vicinity of, but spaced from, the mixing of the primary and secondary flows is sensed.

15. A method according to claim 1, in which the secondary flow of coolant is maintained by a second pump, the operation of which is controlled in dependence upon the indicated temperature.

16. An internal combustion engine assembly including:

an engine body and passageways in the engine body defining a flow path for a circulating primary flow of coolant through the engine body, a first pump for generating the circulating primary flow of coolant, a passage in the engine body leading into the flow path of the primary flow of coolant for enabling a secondary flow of coolant to be injected into and mix with the primary flow at a predetermined location in the engine body;

a sensing device for sensing a variable that provides an indication of the temperature of the engine body in the region where the secondary flow of coolant mixes with the primary flow of coolant; and a control system for controlling the injection of the secondary flow of coolant into the primary flow in dependence upon a signal from the sensing device.

17. An engine assembly according to claim 16, in which the passage in the engine body is such that the secondary flow of coolant is injected into the primary flow as a jet.

18. An engine assembly according to claim 17, in which the passage for the secondary flow has a diameter in the range of 2 to 15 mm where the secondary flow of coolant is injected into the primary flow.

19. An engine assembly according to claim 17, in which the cross-sectional area of the passage for the secondary flow of coolant is less than one third of the cross-sectional area of the passageway for the primary flow of coolant where the secondary flow is injected into the primary flow.

20. An engine assembly according to claim 16, in which the passage for the secondary flow of coolant is arranged such that the jet has a direction that has a substantial component aligned with the direction of primary flow of coolant at the predetermined location.

21. An engine assembly according to claim 16, in which the passage for the secondary flow of coolant is arranged such that the jet is directed substantially perpendicularly to the direction of primary flow of coolant at the predetermined location.

22. An engine assembly according to claim 16, in which there are a plurality of the passages in the engine body leading into the flow path of the primary flow of coolant for enabling the secondary flow of coolant to be injected into and mixed with the primary flow at a plurality of the predetermined locations in the engine body.

23. An engine assembly according to claim 22, in which a plurality of the sensing devices are provided, each of the devices providing an indication of the temperature in the region of a respective one of the predetermined locations in the engine body.

24. An engine assembly according to claim 22, in which the control system is arranged to control the injection of the secondary flow of coolant into the primary flow at each of the predetermined locations in accordance with a signal from the sensing device associated with the region of that predetermined location.

25. An engine assembly according to claim 16, in which the sensing device is a temperature sensing device located in the engine body immediately adjacent to the predetermined location.

26. An engine assembly according to claim 16, in which the sensing device is a temperature sensing device located in the engine body at a location in the vicinity of, but spaced from, the predetermined location.

27. An engine assembly according to claim 16, including a second pump for generating the secondary flow of coolant.

28. An engine assembly according to claim 27, in which the second pump is an electric pump, and the operation of the second pump is controlled by the control system.

29. An internal combustion engine body including:

a plurality of passageways in the engine body defining a flow path for a circulating primary flow of coolant through the engine body;

a passage in the engine body leading into the flow path of the primary flow of coolant for enabling a secondary flow of coolant to be injected into and mix with the primary flow at a predetermined location in the engine body; and a temperature sensing device in the region where the secondary flow of coolant mixes with the primary flow of coolant.

30. An engine body according to claim 29, in which the passage in the engine body is such that the secondary flow of coolant is injected into the primary flow as a jet.

31. An engine body according to claim 30, in which the passage for the secondary flow has a diameter in the range of 2 to 15 mm where the secondary flow of coolant is injected into the primary flow.

32. An engine body according to claim 30, in which the cross-sectional area of the passage for the secondary flow of coolant is less than one third of the cross-sectional area of the passageway for the primary flow of coolant where the secondary flow is injected into the primary flow.

33. An engine body according to claim 30, in which the passage for the secondary flow of coolant is arranged such that the jet has a direction that has a substantial component aligned with the direction of primary flow of coolant at the predetermined location.

34. An engine body according to claim 30, in which the passage for the secondary flow of coolant is arranged such that the jet is directed substantially perpendicularly to the direction of primary flow of coolant at the predetermined location.

35. An engine body according to claim 29, in which there are a plurality of the passages in the engine body leading into the flow path of the primary flow of coolant for enabling the secondary flow of coolant to be injected into and mix with the primary flow at a plurality of the predetermined locations in the engine body.

36. An engine body according to claim 35, in which a plurality of the temperature sensing devices are provided, each device being located in the region of a respective one of the predetermined locations in the engine body.

37. An engine body according to claim 29, in which the temperature sensing device is located in the engine body immediately adjacent to the predetermined location.

38. An engine body according to claim 29, in which the temperature sensing device is located in the engine body at a location in the vicinity of but spaced from the predetermined location.

* * * * *